US008153872B1

(12) United States Patent
Ward

(10) Patent No.: US 8,153,872 B1
(45) Date of Patent: Apr. 10, 2012

(54) STRING KEEPER DEVICE FOR STRINGED MUSICAL INSTRUMENTS

(76) Inventor: John Ward, Costa Mesa, CA (US)

( * ) Notice: Subject to any disclaimer, the term of this patent is extended or adjusted under 35 U.S.C. 154(b) by 65 days.

(21) Appl. No.: 12/925,622

(22) Filed: Oct. 25, 2010

(51) Int. Cl.
*G10D 3/10* (2006.01)

(52) U.S. Cl. ..... 84/297 R; 84/304

(58) Field of Classification Search ..... 84/297 R, 84/304
See application file for complete search history.

(56) References Cited

U.S. PATENT DOCUMENTS

| | | | | | |
|---|---|---|---|---|---|
| 3,726,172 | A * | 4/1973 | Sorkin | 84/304 |
| 4,197,780 | A * | 4/1980 | Smith | 84/458 |
| 4,377,963 | A * | 3/1983 | Siminoff | 84/297 R |
| 4,852,447 | A * | 8/1989 | St. Denis | 84/297 R |
| 5,180,876 | A * | 1/1993 | Thorward | 84/293 |
| 5,372,057 | A * | 12/1994 | Hart | 84/297 R |
| 6,028,255 | A | 2/2000 | Myronyk | |
| 6,489,548 | B1 * | 12/2002 | Schindler | 84/453 |
| 6,600,096 | B2 * | 7/2003 | Jarvis | 84/453 |
| 6,646,193 | B1 * | 11/2003 | Ball | 84/453 |
| 7,569,759 | B2 * | 8/2009 | Pace et al. | 84/453 |
| 7,842,870 | B2 * | 11/2010 | Box et al. | 84/304 |
| 2010/0307315 | A1 * | 12/2010 | Swanson | 84/304 |
| 2011/0154972 | A1 * | 6/2011 | Bisheimer | 84/298 |

* cited by examiner

*Primary Examiner* — Elvin G Enad
*Assistant Examiner* — Robert W Horn

(57) ABSTRACT

This is a device that keeps the stings of a stringed musical instrument from unwinding over the top of open ended tuning machines.

6 Claims, 4 Drawing Sheets

Section A

Section A

STRING KEEPER DEVICE FOR STRINGED MUSICAL INSTRUMENTS

FIELD OF INVENTION

This invention relates to stringed musical instruments

BACKGROUND-PRIOR ART

The following is a tabulation of some prior art that presently appears relevant: Pat. No. 6,028,255, issue date 2000 Feb. 22, Patentee Myronyk A conventional stringed musical instrument typically has an adjustable tuning device which consists of a post and a geared or other leverage system to rotate the post. This invention relates to the typical open ended type of tuning post. A string is attached to the tuning post, and wound around the tuning post to adjust the tension in the string in order to achieve the desired musical pitch or note. The tension in the strings keeps them tightly wound around the tuning posts.

When installing a new string onto the instrument, the initially straight string must be inserted in a small hole or slot perpendicular to the axis of the post, and wound around the post several times before string tension increases. The windings help prevent string slippage when tension increases. There are tuning posts that lock the end of the string to the post prior to winding the post to increase tension, but they still require multiple winds to prevent string breakage where it is locked into place. In practice, the tuning post must be wound with one hand while simultaneously holding the string down and tight to the tuning post with the other hand. The natural tendency of the string is to unwrap itself by flipping over the top of the running post.

When the tension in the strings is released, such as detuning for travel or with a collapsible type of instrument, the strings relax to their permanently deformed diameter that is always larger than the diameter of the tuning post. Thus there is always some spring back of the coiled string as its tension is released resulting in the string unwrapping and flipping over the open end of the tuning post.

Therefore, it is advantageous to have a device that keeps the string tight to the post and from unwrapping and flipping over the open end of the tuning post. It is a further advantage if the device allows for normal string tuning without additional manipulation of the device.

U.S. Pat. No. 6,028,255 to Myronyk proposes a metal arm that clamps the strings to a rubber pad attached to the neck. This device is intended to retain the strings tension on the tuning posts by not allowing them slide through the retainer device. This device requires that it be loosened prior to tuning the strings.

DRAWINGS-REFERENCE NUMERALS-ALL EMBODIMENTS SHOWN

1 Neck
2 Tuning Machine
3 Tuning Machine Peg
4 String
5 String Keeper
6 Tuning Machine Nut
7 Screws

DRAWINGS—FIGURES

DETAILED DESCRIPTION

Figure 1:
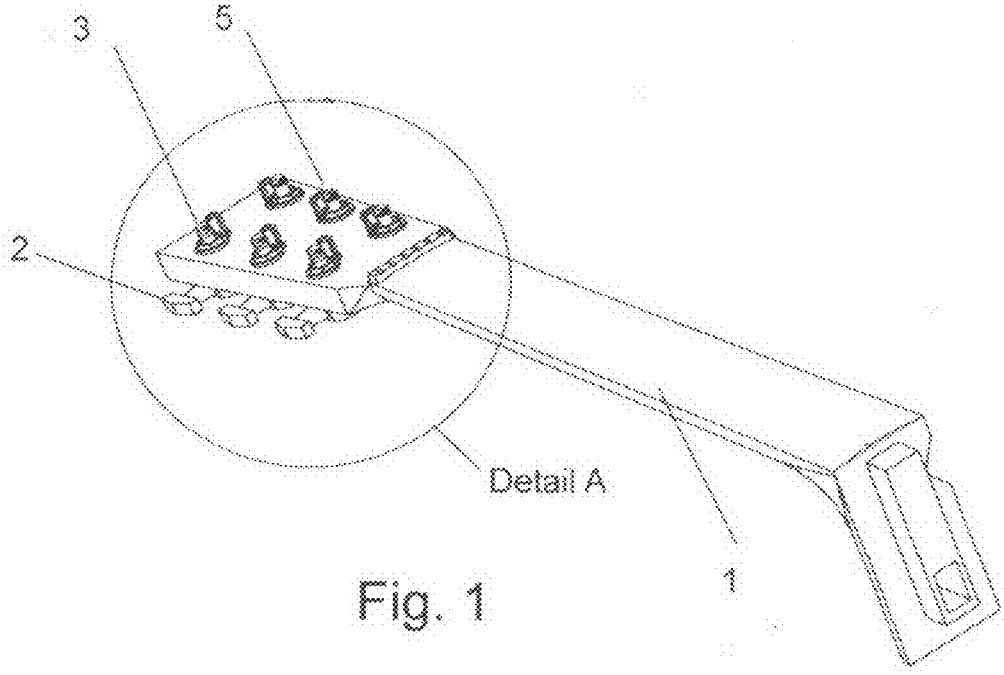
FIG. 1 is a perspective view of a guitar neck assembly (stings not shown)
Figure 2:
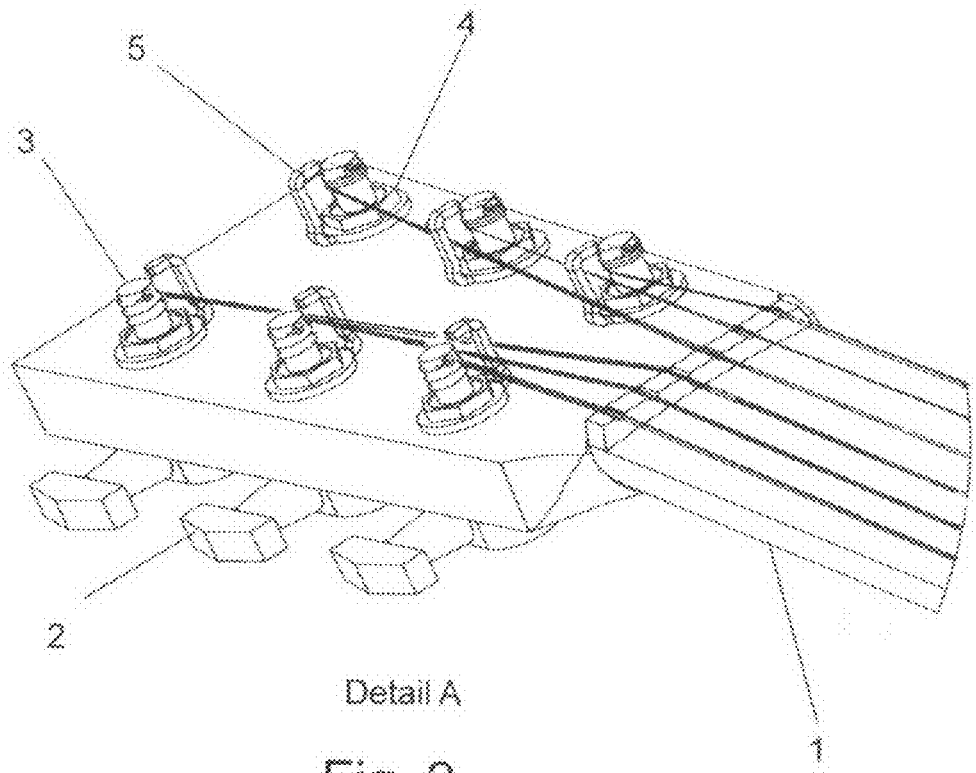
FIG. 2 is a detail view of the guitar neck assembly.
Figure 3:
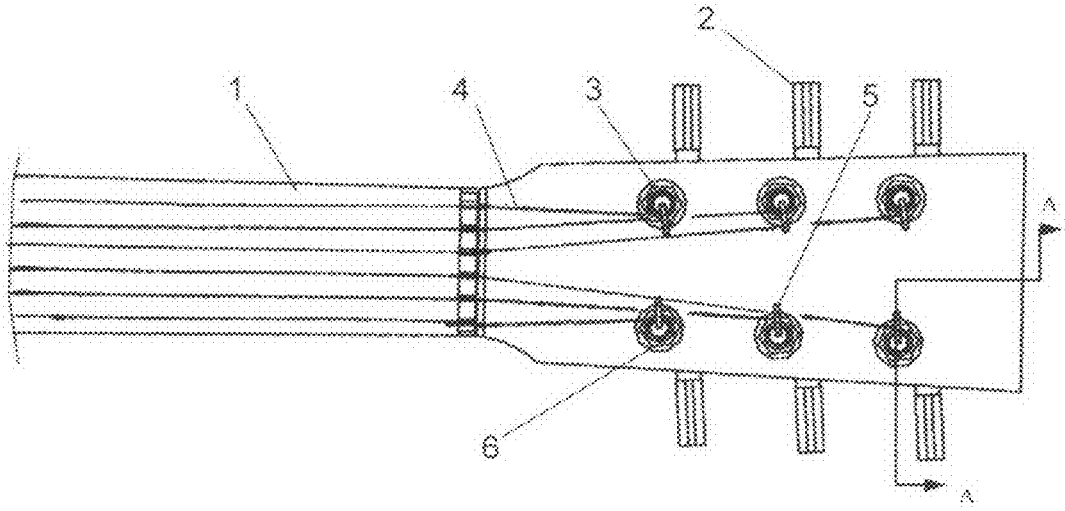
FIG. 3 is a partial top view of the guitar neck assembly.
Figure 4:
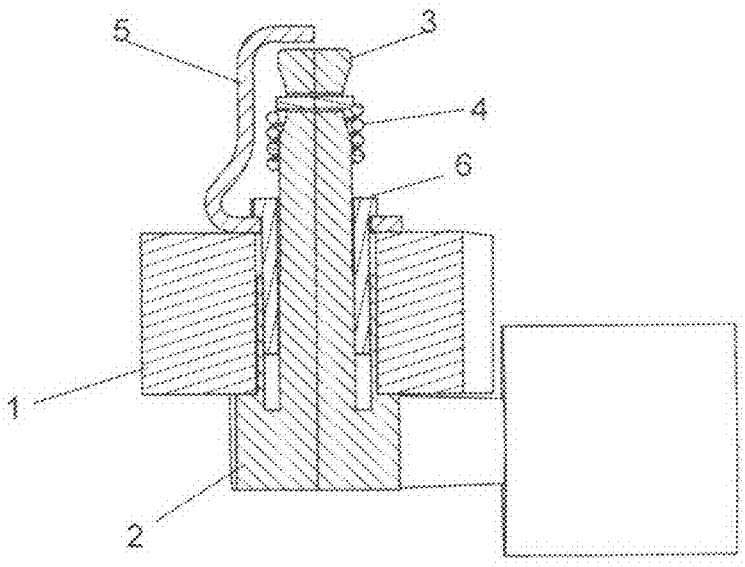
FIG. 4 is a cross-sectional view of the guitar neck assembly
Figure 5:
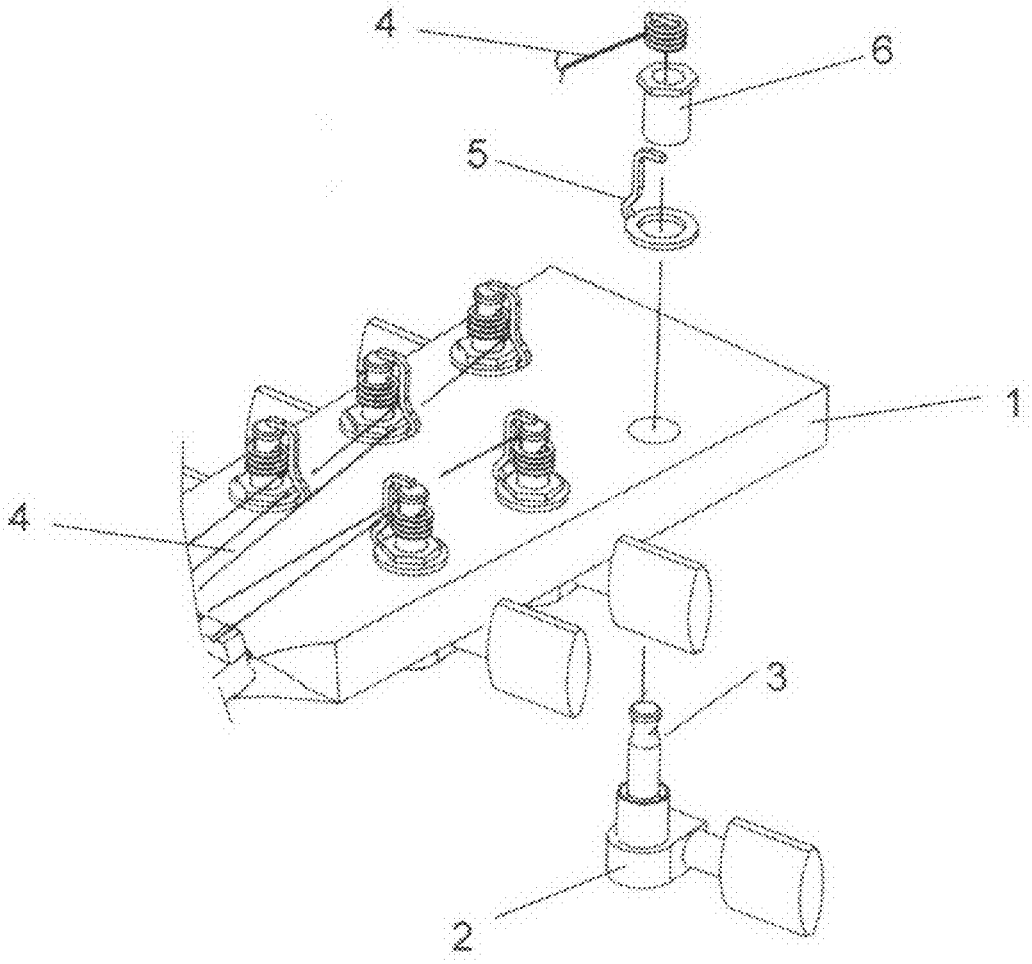
FIG. 5 is an exploded view of the guitar neck assembly

One embodiment of the string keeper is illustrated in FIG. 1 , and FIG. 2 (detailA). A tuning machine 2, tuning machine post 3, string 4, and string keeper 5 are attached to a neck 1. FIG. 3 (top view) and FIG. 4 show a cross section view of a neck 1, tuning machine 2, tuning machine post 3, string 4, string keeper 5, and tuning machine nut 6. FIG. 5 is an exploded view of one of the assemblies showing a neck 1, tuning machine 2, tuning machine post 3, string 4, string keeper 5, and tuning machine nut 6.

INSTALLATION-OPERATION

The string keeper 5 is installed onto the instrument by removing the tuning machine nut 6 and any washer between the tuning machine nut 6 and the neck 1. The tuning machine nut 6 is tightened to clamp the string keeper 5 to the neck 1. The instrument is tuned and played with no further manipulation of the string keeper 5.

ALTERNATE EMBODIMENTS

Figure 6:
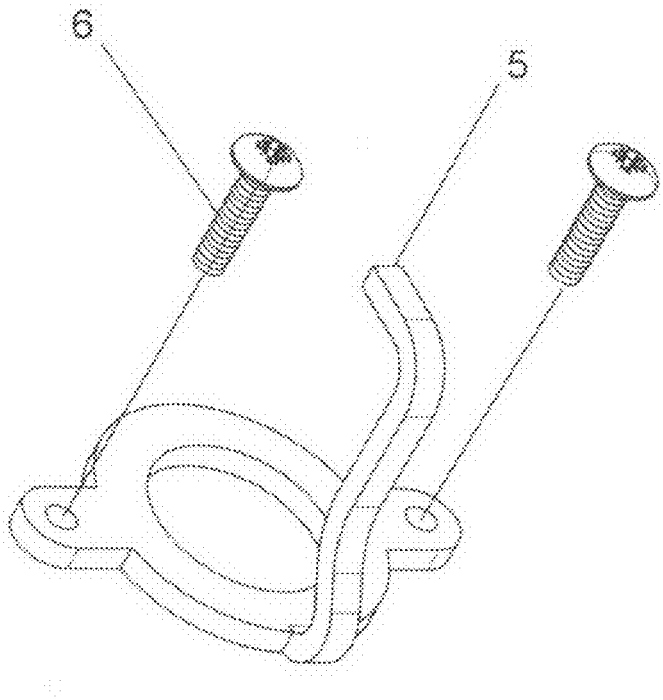
FIG. 6 is a perspective view of an alternate embodiment of the string keeper
Figure 7:
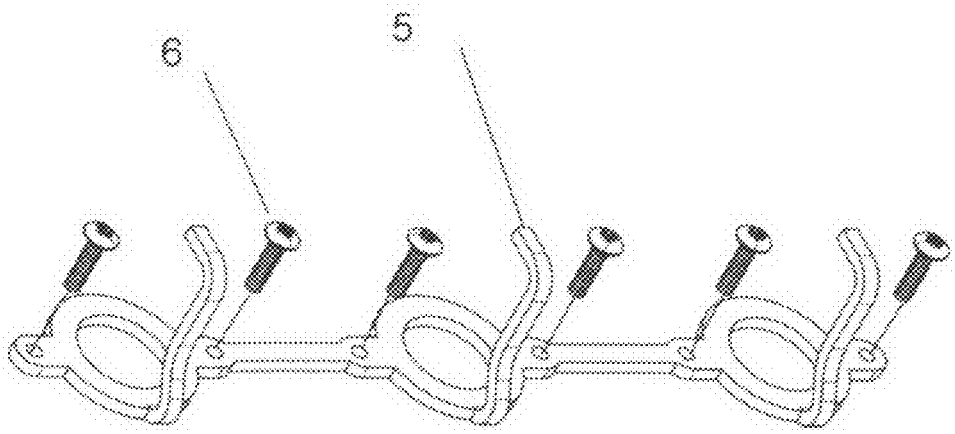
FIG. 7 is a perspective view of another alternate embodiment of the string keeper

Not all tuning machines 2 have tuning machine nuts 6. FIG. 6 shows one alternative embodiment where the string keeper 5 has small mounting holes for screws 7 to hold the string keeper 5 in place on the neck 1. FIG. 7 shows another embodiment where a multiple of string keepers 5 with small mounting holes are connected and collectively fastened to the neck 1 with screws 7. It is envisioned that the string keeper 5 could be spring loaded to press inward toward the tuning post 3 and hold the strings 4 tightly to the tuning machine post 3. There are numerous variations possible for mounting the string keeper 5 to the neck 1.

ADVANTAGES (a) The string keeper 5 keeps the string 4 close to the tuning machine post 3 and prevents the string 4 from unraveling or unwinding over the top of the tuning machine post 3 in any operation where the string 4 tension is low or released. The string keeper 5 makes the task of putting a new string on the instrument much easier by preventing the initially straight string 4 from unwinding by flipping over the open top of the tuning machine post 3. The string keeper 5 also keeps the tuned or tensioned string 4 from unwrapping by flipping over the top of the tuning machine post 3 when the string 4 tension is released such as happens with some collapsible stringed instruments (b) Any open ended tuning machines 1 can be fitted with a string keeper 5

(c) The string keeper 5 does not require any modifications to the normal construction and characteristics of an industry standard stringed instrument.

(d) The string keeper 5 does not change the normal tuning and playing of the instrument.

CONCLUSIONS, RAMIFICATIONS, AND SCOPE

Accordingly, the reader will see that my string keeper prevents string unwinding and thus provides an easier way to put new strings onto an instrument, and it keeps the strings in place when releasing string tension as in a collapsible stringed musical instrument. Also, my string keeper will not alter the basic industry standard shape for stringed musical instruments nor does it interfere with normal tuning. My string keeper can be used on, but not limited to, solid body guitars, hollow body guitars, banjos, mandolins, violins, and ukuleles. While my string keeper has been described and defined by reference to the embodiments shown, such reference does not imply a limitation on the scope of the embodiments, and no such limitation is to be inferred. My string keeper is capable of considerable modification, alteration, and equivalents in form and function, as will occur to those ordinarily skilled and knowledgeable in the pertinent arts. The depicted and described embodiments of my string keeper are exemplary only, and is not exhaustive of the scope my invention. Consequently, the scope is intended to be limited only by the spirit and scope of the appended claims, giving full cognizance to equivalents in all respects.

I claim:

1. A device for prevention of string unwinding over the open end of a tuning machine post for a stringed musical instrument comprising:

an arm attached to said instrument, said arm in close proximity to the tuning machine post, and said arm having a geometric shape such that the string cannot unwind and cross over the open end of the tuning machine.

2. The device as in claim 1, wherein said arm is spring loaded to keep the strings in close proximity to the tuning machine post.

3. The device as in claim 1, wherein said arm comprises several connected arms.

4. The device as in claim 1, wherein said arm comprises a washer-like ring connected to the instrument by removing the tuning machine nut and any washer and the ring is placed over the post and tightened down by the tuning machine nut.

5. The device as in claim 1, wherein said arm comprises a washer-like ring and tabs with screw holes and is connected to the instrument by the ring being placed over the post and the screws turned into the instrument head stock.

6. The device as in claim 5, wherein the device is an array of devices ganged together for prevention of string unwinding over the open end of a plurality of tuning machine posts and each ganged device has a pair of screw holes, a pair of screws and an arm for a respective winding post and respective devices include connection to another device by an interconnection structure.

* * * * *